US009221059B2

(12) United States Patent
Blondin et al.

(10) Patent No.: US 9,221,059 B2
(45) Date of Patent: Dec. 29, 2015

(54) MOBILE CRUSHING SYSTEM

(75) Inventors: Wolfgang Blondin, Duisburg (DE); Wolfgang Genius, Essen (DE); Frank Schneider, Duisburg (DE)

(73) Assignee: Thyssenkrupp Resource Technologies GmbH, Essen (DE)

( * ) Notice: Subject to any disclaimer, the term of this patent is extended or adjusted under 35 U.S.C. 154(b) by 323 days.

(21) Appl. No.: 13/978,252

(22) PCT Filed: Dec. 22, 2011

(86) PCT No.: PCT/EP2011/006499

§ 371 (c)(1),
(2), (4) Date: Sep. 6, 2013

(87) PCT Pub. No.: WO2012/092953

PCT Pub. Date: Jul. 12, 2012

(65) Prior Publication Data

US 2013/0341447 A1 Dec. 26, 2013

(30) Foreign Application Priority Data

Jan. 3, 2011 (DE) ..... 10 2011 000 015

(51) Int. Cl.
*B02C 21/02* (2006.01)

(52) U.S. Cl.
CPC ..... *B02C 21/02* (2013.01); *B02C 21/026* (2013.01); *B02C 2021/023* (2013.01)

(58) Field of Classification Search
CPC .... B02C 21/02; B02C 21/023; B02C 21/026; B02C 2021/023
USPC ..... 241/101.741–101.76
See application file for complete search history.

(56) References Cited

U.S. PATENT DOCUMENTS

| | | | | |
|---|---|---|---|---|
| 3,924,876 | A | 12/1975 | Vaillant et al. | |
| 4,491,279 | A | 1/1985 | Long et al. | |
| 4,655,402 | A * | 4/1987 | Desourdy | 241/76 |
| 4,712,744 | A * | 12/1987 | Kirchhoff et al. | 241/80 |
| 4,763,845 | A | 8/1988 | Guggenheimer et al. | |

(Continued)

FOREIGN PATENT DOCUMENTS

| | | | |
|---|---|---|---|
| AT | 388968 | B | 9/1989 |
| CN | 201132132 | Y | 10/2008 |

(Continued)

*Primary Examiner* — Faye Francis
(74) *Attorney, Agent, or Firm* — Laurence Greenberg; Werner Stemer; Ralph Locher

(57) ABSTRACT

A mobile crushing system with a sub-construction features at least one chassis and a superstructure featuring at least one receiving hopper, a crusher and a transport device. The superstructure features rigid bearings, and a hoisting device for raising and lowering the superstructure relative to the sub-construction and is provided between the superstructure and sub-construction. The superstructure is supported against the sub-construction by the hoisting device during traveling operation. The superstructure can be placed on the ground by the bearings by lowering the superstructure with the hoisting device during crushing operation in such a way that the bearings at least partially transmit the weight of the superstructure along with dynamic and static forces acting on the superstructure directly onto the ground.

11 Claims, 2 Drawing Sheets

(56) References Cited

U.S. PATENT DOCUMENTS

| | | | | |
|---|---|---|---|---|
| 4,881,691 | A * | 11/1989 | Oldengott et al. | 241/101.5 |
| 5,441,206 | A | 8/1995 | Schade et al. | |
| 7,182,284 | B2 | 2/2007 | Jabs et al. | |
| 7,340,973 | B2 | 3/2008 | Hiraiwa | |
| 7,360,466 | B2 | 4/2008 | Seo | |
| 7,870,804 | B2 | 1/2011 | Bjorck et al. | |
| 8,020,800 | B2 * | 9/2011 | Potts | 241/101.74 |
| 8,366,201 | B2 | 2/2013 | Drummond et al. | |
| 8,583,322 | B2 * | 11/2013 | Yamaguchi et al. | 701/36 |
| 2001/0020656 | A1 * | 9/2001 | Frick | 241/101.74 |
| 2010/0090042 | A1 * | 4/2010 | Potts | 241/101.74 |
| 2010/0257962 | A1 | 10/2010 | Recker et al. | |
| 2013/0153699 | A1 * | 6/2013 | Davis | 241/101.74 |

FOREIGN PATENT DOCUMENTS

| | | | |
|---|---|---|---|
| DE | 2357364 | | 5/1974 |
| DE | 2834987 | A1 | 2/1980 |
| DE | 3608789 | A1 | 9/1987 |
| DE | 4323492 | A1 | 1/1995 |
| DE | 10015336 | A1 | 10/2001 |
| DE | 112004000109 | T5 | 12/2005 |
| DE | 102009002346 | A1 | 10/2010 |
| EP | 1615723 | A1 | 1/2006 |
| SU | 369928 | A1 | 2/1973 |
| WO | 9954049 | A1 | 10/1999 |
| WO | 02092331 | A1 | 11/2002 |
| WO | 2006033849 | A2 | 3/2006 |

* cited by examiner

MOBILE CRUSHING SYSTEM

BACKGROUND OF THE INVENTION

Field of the Invention

The invention relates to a mobile crushing system with a sub-construction having at least one chassis and a superstructure having at least one receiving hopper, a crusher and a transport device. Mobile crushing systems are equipped with their own chassis, and can thus be displaced as a unit. As a result, mobile crushing systems differ from semi-mobile crushing systems, which while basically transportable, do not feature their own chassis. In addition, stationary crushing systems are known that are built for permanent application at a single location. These can only be dismantled, and not transported and moved completely intact.

Mobile crushing systems are often used in extracting mineral substances such as mineral ores and rocks, organic substances such as carbon, and in conveying mining waste. In order to be able to transport useful material to be exploited or mining waste away from an extraction area by means of conveyor belts, the corresponding materials cannot exceed a certain grain size. Known in the art is to use a loader or bagger to pour the materials to be extracted or, when clearing the useful material, the overlying mining waste into receiving hoppers of the mobile crushing systems, for example after a blasting operation for loosening purposes.

Mobile crushing systems must feature an especially high level of stability, because along with a high intrinsic weight and the weight of the material to be crushed, very high dynamic forces must also be accommodated, for example which can stem from the discontinuous charging of material to be crushed along with vibrations and oscillations of the crusher.

Known for crushing systems is to support the superstructure only against the chassis of the sub-construction, wherein the stress placed on the chassis components can be very high due to the arising dynamic loading forces, depending on the used crusher type. EP 1 615 723 B1 discloses a mobile crusher in which the supporting is provided solely by several chassis of the sub-construction. Known from DE 36 08 789 A1 is a mobile crushing system equipped with auxiliary chassis that can be raised and lowered. Even in such a configuration, the problem becomes that the chassis components of the main chassis or auxiliary chassis are exposed to very high loads during crushing operation.

Mobile crushing systems with the features described at the outset that feature movable, extendible bearings are known for reducing the stresses placed on the chassis and oscillations at the ejection end of the discharging transport device during crushing operation. In the bearing involving only one side of the chassis known from DE 28 34 987 A1 and AT 388 968 B, the chassis must further absorb a portion of weight force along with the dynamic forces, even if the movable bearing under the receiving hopper absorbs at least most of the weight force exerted by the material to be crushed. However, it is precisely dynamic forces, for example which can be generated by the operation of the crusher and constitute a particularly high load, that cannot be kept away from the chassis. In addition, relatively small pediments are usually sufficient for movable bearings, since the primary loads are conveyed from the chassis onto the ground.

Known from DE 43 23 492 A1 and WO 02/092231 A1 are mobile crushing systems that feature extendible bearings on both sides of the chassis, which due to the very large forces to be absorbed are usually hydraulically driven. The static and dynamic forces on the chassis can be relieved by providing bearing on two sides of the chassis. Since at least most of the weight force of the superstructure and the charged material to be crushed along with the dynamic forces must be absorbed by the movable, usually hydraulically operated bearings, these bearings must be correspondingly stably equipped. Cost and weight considerations require that a compromise be reached between the economic efficiency and reliability of the system as relates to the adjustable bearings. In particular, the movable bearings may become worn during continuous operation or be destroyed given operational disruptions. For example, if the bagger provided for charging the material to be crushed on the receiving bunker hits the mobile crushing system due to a malfunction, the extreme dynamic forces can then not be absorbed by a hydraulic system rated for conventional loads, thereby creating the risk of damage, which would then necessitate expensive repair and maintenance. The crushing operation must be suspended during such an overhaul, so that the entire process of conveying the material to be crushed can be interrupted. In addition, all static and dynamic forces in this arrangement act over the entire hydraulic device (cylinders, valves, lines, connections, drive, controller, etc.). Thus, the latter must have correspondingly complex and stable dimensions, which is unnecessarily expensive.

From DE 2 357 364 bearings are known that are comparatively easy to extend, which during crushing operation absorb the static and dynamic forces in a strictly mechanical manner. A hydraulic drive is only provided to move the bearing from a raised into a lowered position. In order to place the bearings in the lowered position on a ground, air is released from pneumatic tires of the chassis, thereby lowering the sub-construction and superstructure rigidly secured thereto. While the described configuration is characterized by a comparatively simple design, the fulcrums and stops are weak points that are exposed to elevated wear, and can break or deform when exposed to a sudden, abrupt force, for example from impacting blades of a conveyor bagger.

With respect to the dynamic forces, attention must be paid not just to the vibrations and concussions generated by charging and conveying the material to be crushed, but also to vibrations and imbalances that can be attributed to crushing the material. For example, while roll crushers run relatively uniformly due to the continuous rotation and essentially generate vibrations and slight impacts, significant imbalances arise in a jaw crusher, which lead to elevated dynamic loads.

BRIEF SUMMARY OF THE INVENTION

Against this backdrop, the object of the invention is to provide a mobile crushing system that is highly reliable, while having as simple and lightweight, low-built a structure as possible.

Proceeding from a mobile crushing system with the features described at the outset, the object is achieved according to the invention by virtue of the fact that the superstructure features rigid bearings, and a hoisting device for raising and lowering the superstructure relative to the sub-construction is provided between the superstructure and sub-construction, wherein, when the mobile crushing system is in the traveling mode, the superstructure is supported on the sub-construction by the hoisting device, and raised from the sub-construction, and wherein, in the crushing mode, the superstructure can be lowered by the hoisting device and placed on the bearings in such a way that the bearings at least partially absorb the weight of the superstructure along with dynamic and static forces acting on the superstructure, and divert them directly onto the ground.

According to the invention rigid, nonadjustable bearings are provided, for example which can be designed as part of a frame for the superstructure, or undetachably joined as a steel structure with a frame for the superstructure, in particular welded. The rigid, immovable configuration of the bearings allows them to be easily designed with a high level of stability, while omitting weak points, such as rotational axes, hydraulic devices or the like. The entire superstructure including the bearings thus forms a rigid, stable structure, which can withstand even extreme stresses, for example impacting bagger blades or the like, without any special protective measures. The pediments of the bearings can here easily be made large enough not to sink even given a relatively soft/yielding ground.

Since the bearings absorb at least part of the weight force of the superstructure, the charged material to be crushed as well as the dynamic forces during crushing operation, the chassis and entire hydraulic device (cylinders, valves, lines, connections, drive, controller, etc.) are relieved all in equal measure. In this conjunction, the invention is based on the knowledge that a rigid connection between the superstructure and sub-construction can yield a significant load during crushing operation, in particular owing to dynamic forces. Against this backdrop, the mobile crushing system makes it possible to at least partially or preferably completely decouple the superstructure from the sub-construction during crushing operation.

A preferred embodiment of the invention provides that the superstructure can be lowered by the hoisting device and placed on the bearing in such a way that the latter completely absorbs the weight of the superstructure as well as the dynamic and static forces acting on the superstructure. In the framework of such an embodiment, the superstructure and sub-construction can be mechanically completely separated from each other except for supply lines or the like, wherein a gap is then usually formed between the superstructure and sub-construction at the corresponding support locations.

Alternatively, it is also possible to have the preferably hydraulic hoisting device exposed to no load or provide it with a significantly lower pressure. In both instances, the static and dynamic loads acting on the sub-construction are at least very tangibly diminished.

The hoisting device can be secured to the superstructure or sub-construction, wherein the allocated hoisting means are rigidly supported only on the corresponding side. For example, hydraulic cylinders attached to the superstructure that press against an allocated opposite surface of the sub-construction during extension are suitable.

In particular given a hydraulic hoisting device, it is as a rule preferred that the hydraulic cylinders or stamps be rigidly secured to the superstructure, since the additional hydraulic components, such as a pressure generator and pressure line system, can be easily arranged on the superstructure, which usually also features other electromechanical and/or electropneumatic devices for operating the additional components of the crushing system.

In an alternative embodiment, the hoisting device can also feature an electromechanical drive, for example a lantern pinion. In such a drive, the driving means are preferably also secured to the superstructure, since the connection is often easier to establish there, and more installation space is available.

Within the framework of the invention, the weight of the sub-construction rests on the ground during crushing operation. According to a preferred embodiment of the invention, the hoisting device is provided to convey only compressive forces, and not tensile forces, between the superstructure and the sub-construction. Once the superstructure has been completely lowered, the compression means are then detached either from the superstructure or the sub-construction, depending on configuration, since the latter are not provided for transmitting a tensile force, and correspondingly also only securely clamped in on one side. As a consequence, the sub-construction with the at least one chassis is also not lifted from the ground during crushing operation. Thus, it must be remembered that the chassis features a significant weight, so that a hoisting would be associated with corresponding additional loads. There would also not be any complete relief with regard to dynamic forces, such as vibrations, if the chassis were to be lifted by the hoisting device, and correspondingly still be mechanically coupled to the superstructure. Nonetheless, one of the possible embodiments within the framework of the invention provides that the chassis be raised or jacked by the hoisting device to place the superstructure onto the ground. This can be advantageous in particular if it would be difficult or disproportionately expensive to center the guiding elements between the superstructure and the sub-construction before lifting the superstructure for traveling operations.

If in a preferred embodiment the superstructure and the sub-construction are completely decoupled from each other during crushing operation aside from the supply lines or the like, as described above, the superstructure can move in a certain way relative to the sub-construction. This resultant risk is that the superstructure will shift to a certain extent in relation to the sub-construction due to vibrations or impacts. In addition, the sub-construction can also travel a little, for example to move it out of a danger zone via a slight displacement under the superstructure.

However, the problem with this mobility is that no precise alignment of the superstructure and the sub-construction is assured when activating the hoisting device to lift the superstructure relative to the sub-construction while transitioning from crushing operation to traveling operation. In order to offset a certain displacement in this conjunction, it makes sense to provide guiding and/or centering means for aligning the superstructure in relation to the sub-construction in a hoisting operation. In an especially simple embodiment of the invention, wedge surfaces can be provided as the centering means on the superstructure and/or the sub-construction. Aside from mutually arranged wedge surfaces, beveled bearings for the hoisting means, in particular hydraulic cylinders, can be provided, which initiate automatic centering while lifting. In addition, separate guiding pins and/or guiding rails can also be provided as the guiding means. However, the latter are preferably designed in such a way as not to transmit any significant forces from the superstructure to the sub-construction during crushing operation.

In addition, it is possible to provide the hoisting device with attenuating elements, which makes sense in particular if the load is not completely removed from the sub-construction with the chassis during crushing operation, and/or if operations are expected to result in displacements between the superstructure and the sub-construction.

In a preferred embodiment of the invention, the at least one chassis of the sub-construction features two parallel drive sets, in particular a crawler pair. Two wheel sets can also be used as an alternative. By comparison to several chassis each with only a single drive set of a chassis with more than three drive sets, which can basically be used as an alternative within the framework of the invention, a chassis with precisely two drive sets is distinguished by a very good maneuverability and mobility.

The chassis with its preferably two drive sets, in particular crawlers, can be situated longitudinally or transverse to the transport direction of the material to be crushed. As explained above, the sub-construction in the lowered state can also be moved under the sub-construction to a certain extent. While a corresponding structural configuration in which the chassis can be switched between a transverse and longitudinal alignment is also conceivable, respectively suitable guiding and/or centering means must then be provided on the superstructure and/or the sub-construction for both the transverse and longitudinal alignments.

According to the invention, the mobile crushing system features bearings, which make it possible to decouple the superstructure from the sub-construction. In order to reduce the totality of loads acting on the crushing system during crushing operation, the at least one chassis in a preferred embodiment of the invention is arranged between the receiving hopper and crusher as viewed in a transport direction of the material to be crushed in the crushing system, wherein it is then especially preferred that a first bearing be located underneath the receiving hopper, and a second bearing be located underneath the crusher. Owing to the very high weight, not just large static forces are at play under the receiving hopper and crusher, but also considerable dynamic forces, for example which may be attributed in particular to the pouring of material to be crushed into the receiving hopper, movements by the crusher, and potential impacts of outside forces.

The specific configuration of the crushing system is also important with respect to the loads placed on the mobile crushing system by the especially critical dynamic forces. The mobile crusher according to the invention can basically be provided with all known crushers. Directly supporting the superstructure on the ground and diverting the forces into the ground yields a special suitability for crushers that lead to large dynamic loads when in operation due to imbalances or the like. The mobile crusher system can correspondingly also be readily provided with a jaw crusher, the drive of which generates significant imbalance forces, which are introduced into the superstructure as dynamic forces.

As explained above, the rigid, immovable bearings are usually part of a supporting frame of the superstructure, or at least fixedly joined with the superstructure, especially welded. In particular, the bearings can be designed as a steel structure resembling a pontoon.

As explained above, the mobile crushing system according to the invention is featured by a simple structural design and a very high reliability, since the loads acting on the chassis, in particular dynamic loads, can be reduced or even completely avoided. Another advantage is that the height of the mobile crushing system can be reduced, since the bearings need not be equipped with an adjustment device or the like.

For a further configuration the mobile crusher system usually involves a discharge conveyor with at least one stacker boom, which can be designed as a belt conveyor. The stacker boom can be guided either directly under the crusher and a sieve device optionally placed upstream from the crusher. If the stacker boom can then be pivoted around a vertical axis for changing the discharge range, this axis best lies within the area of a crusher discharge. As an alternative, an additional delivery belt preceding the stacker boom can be provided under the crusher and sieve device optionally upstream from it. Regardless of whether a delivery belt is optionally provided upstream, it is advantageous that the stacker boom also be able to pivot in a vertical direction so as to adjust the discharge height. In order to feed the material to be crushed that was accumulated in the receiving hopper to the crusher, a transport device is usually provided in the form of a plate conveyor or the like. However, a sequence of clockwise rotating transport or sieve rollers can also serve this purpose, under which already sieved fine grained material is fed directly to the stacker boom via the mentioned additional delivery belt.

Because of its robustness and reliability, the mobile crushing system according to the invention is also suitable for strip mining operations involving deposits of hard rock. It must be remembered in this conjunction that, for reasons of cost, preference is increasingly being shown for extraction systems that do not use trucks for transport purposes, and instead transport material exclusively with conveyor belts. However, this necessitates that the material be comminuted to a suitable grain size prior to transport, so as to avoid damage to the conveyor belts or problems at transfer stations between conveyor belts. For example, if rock or a useful material is mined by way of explosions during strip mining operations, it is intermittently charged onto the mobile crushing system via a hydraulic bagger. Thus, it must be remembered that such a hydraulic bagger features a certain deployable radius given its bagger arm and its forward drive, thereby eliminating the need to constantly reposition the mobile crushing system. Under normal conditions of use, for example, it may be expedient to alter the position of the crushing system several times during the day. The mobile crushing system according to the invention enables an especially fast and reliable positional change of this type with simple means. In addition, it is especially easy to move the mobile crushing system to another job site, wherein the superstructure is then reliably supported against the sub-construction by the preferably hydraulic hoisting device during traveling operation.

The invention will be explained below based on a drawing that only represents an exemplary embodiment.

DESCRIPTION OF THE INVENTION

Figure 1:
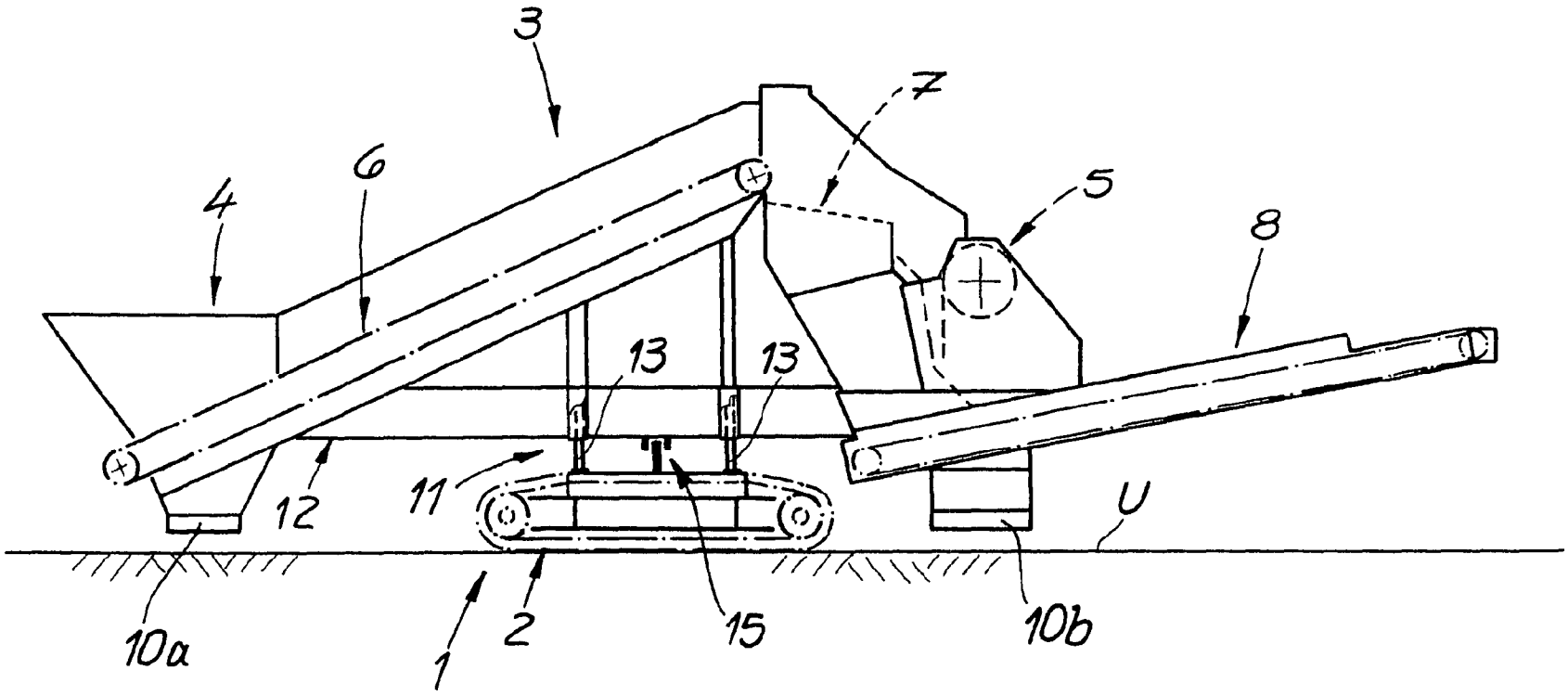
FIG. 1 is a mobile crushing system according to the invention as configured during traveling operations.

The mobile crushing system according to the invention features a sub-construction 1 with a chassis 2 and a superstructure 3, which features at least one receiving hopper 4, a crusher 5 and a transport device.

According to the depicted exemplary embodiment, a conveyor 6 is provided so that the crushing material B that was poured into the receiving hopper 4 can be poured into the crusher 5 from above. The mobile crushing system is provided in particular to comminute large chunks of material, which cannot be readily loaded onto conveyor belt systems. However, a conventional grain size distribution for the material to be crushed also includes a percentage of fines that does not have to be crushed. For this reason, a sieve device 7 that discharges the share of fines is arranged between the conveyor 6 and crusher 5 in the exemplary embodiment shown. By contrast, larger chucks make their way into the working gap of the crusher 5, which is designed as a jaw crusher in the exemplary embodiment.

The filtered share of fines along with the crushing material B make their way under the crusher 5 and onto a discharge conveyor in the form of a stacker boom 8. The stacker boom 8 can be pivotable around a vertical axis, so as to vary the discharge range relative to a belt system 9 that runs more or less transverse to the conveying direction x of the crushing material B in the mobile crushing system. In addition, the stacker boom 8 can also be tiltable around a horizontal axis, thereby also making it possible to adjust the discharge height at the outer end of the stacker boom 8.

The mobile crushing system according to the invention is featured by rigid, nonadjustable bearings 10*a*, 10*b*, which are situated in front and back of the chassis as viewed in the conveying direction x of the crushing material B, wherein a first bearing 10*a* is located directly underneath the receiving hopper 4, and a second bearing 10*b* is located roughly underneath the crusher 5.

In the traveling operation of the mobile crushing system depicted on FIG. 1, the superstructure 3 is lifted from the sub-construction 1 by a hoisting device 11 from a ground U, leaving a distance between the bearings 10*a*, 10*b* and the ground U that allows the mobile crushing system to move even given certain surface irregularities. According to the invention, the bearings 10*a*, 10*b* are a rigid constituent in a support frame 12 of the superstructure 3 or joined permanently and undetachably with the support frame 12, in particular welded. In the exemplary embodiment, the bearings 10*a*, 10*b* are formed by a steel structure that ensures a very high strength and load-bearing capacity given a comparatively simple and cost-effective structure.

Figure 2:
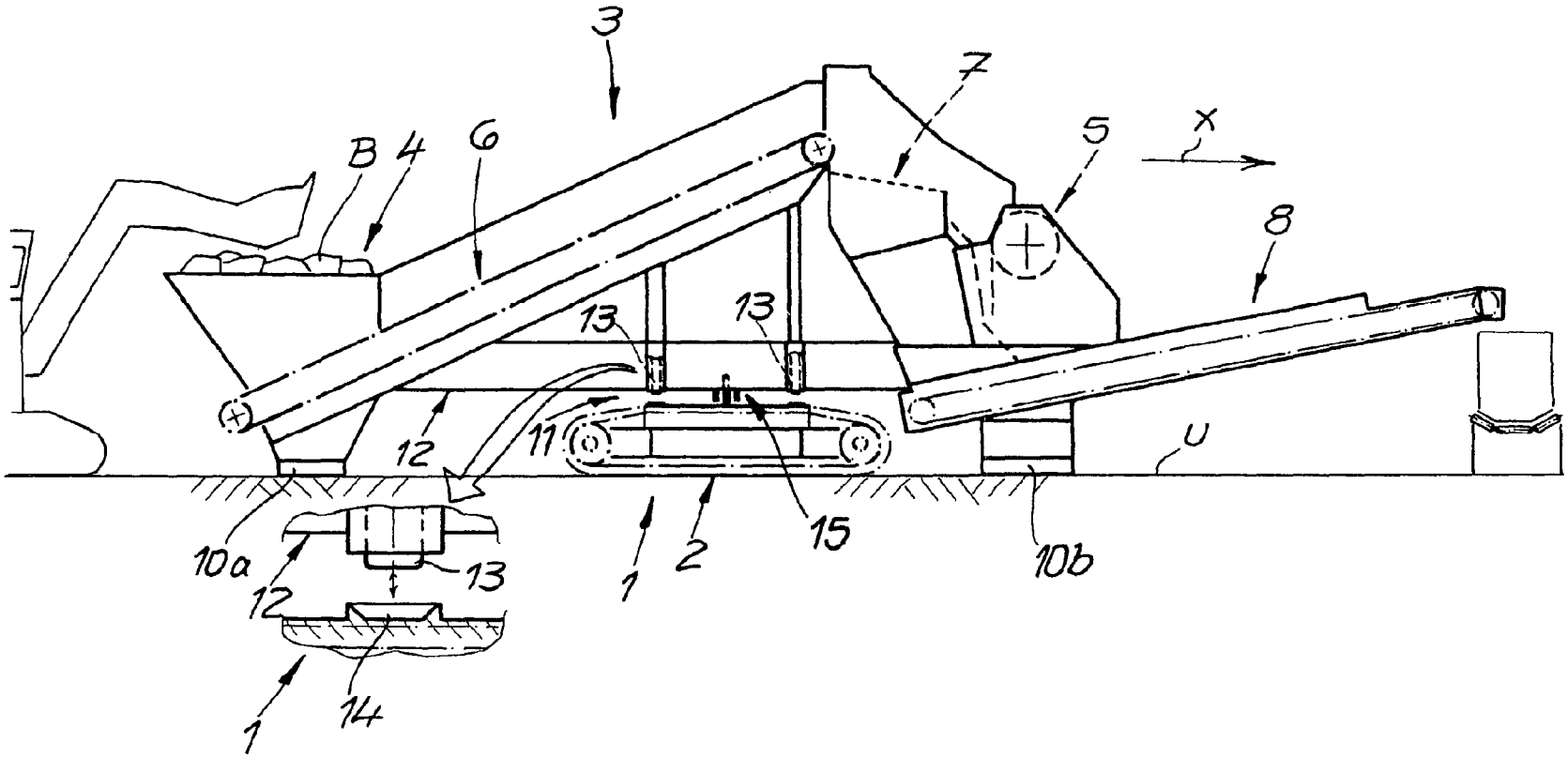
FIG. 2 is the mobile crushing system according to FIG. 1 during crushing operations.

As evident from a comparative evaluation of FIG. 1 and FIG. 2, retracting the hydraulic cylinders 13 of the hoisting device 11 places the superstructure 3 or support frame 12 on its bearings 10*a*, 10*b*, which correspondingly relieves the load on the sub-construction 1 with the chassis 2. In particular, the adjusting means of the hoisting device 11, i.e., the hydraulic cylinder 13 in the exemplary embodiment, are only attached to the superstructure 3 or the sub-construction 1. According to a detailed view on FIG. 2, the hydraulic cylinders 13 are secured to the superstructure 3, and there attached to a hydraulic system (not depicted).

As shown by the detailed view on FIG. 2, the hydraulic cylinders 13 can preferably be retracted to such an extent as to mechanically completely decouple the superstructure 3 from the sub-construction 1. All static and dynamic forces acting on the superstructure 3 are absorbed by the stable, rigid bearings 10*a*, 10*b*. At most supply lines are provided between the superstructure 3 and sub-construction 1, but these cause no significant transmission of force. The chassis 2 is usually provided with an electric drive supplied from the superstructure 3.

Since the superstructure 3 is mechanically completely separated from the sub-construction 1 according to FIG. 2, the superstructure 3 can inadvertently move horizontally relative to the sub-construction 1 as the result of impacts and vibrations, or by purposefully moving the sub-construction 1. The resultant problem is that the relative position between the superstructure 3 and sub-construction 1 is not precisely set when the hoisting device 11 is activated to raise the superstructure 3. In this conjunction, guiding and/or centering means are best provided to achieve an exact horizontal positioning between the sub-construction 1 and superstructure 3. The exemplary embodiment on FIG. 2 presents a detailed view of the hydraulic cylinders 13 of the hoisting device 11, which engage into a conically expanded receptacle 14 of the sub-construction 1 when extended. Additionally or alternatively, however, the superstructure and sub-construction 1 can be provided with mutually allocated centering and guiding means 15, e.g., wedge surfaces, guiding pins or guiding rails. For example, centering means resembling a coupling pin can be provided, wherein centering is usually required at least at two locations spaced apart from each other to ensure a precise alignment and the transmission of horizontal forces and moments.

According to the present invention, it is possible to decouple the sub-construction 1 from the superstructure 3 with respect to the dynamic and static forces. As a result, the significant loads in the crushing operations depicted on FIG. 2 do not act on the chassis 2. In addition, use is not made of sensitive, movable bearings of the kind known from prior art.

The invention claimed is:

1. A mobile crushing system, comprising:

a sub-construction having at least one chassis;

a superstructure having at least one receiving hopper, a crusher, a transport device, and rigid bearings; and a hoisting device for raising and lowering said superstructure relative to said sub-construction disposed between said superstructure and said sub-construction, said hoisting device supported on said superstructure, said superstructure supported against said sub-construction by said hoisting device during traveling operation, and said superstructure can be placed on a ground by means of said rigid bearings by lowering said superstructure with said hoisting device during a crushing operation such that said rigid bearings at least partially transmit a weight of said superstructure along with dynamic and static forces acting on said superstructure directly onto the ground, said hoisting device completely decouples said superstructure from said sub-construction when said superstructure is in an operation position positioned on the ground.

2. The mobile crushing system according to claim 1, wherein said at least one chassis has two parallel drive sets.

3. The mobile crushing system according to claim 1, wherein said at least one chassis is disposed between said receiving hopper and said crusher as viewed in a transport direction of a crushing material in the mobile crushing system, wherein a first bearing of said rigid bearings is disposed underneath said receiving hopper, and a second bearing of said rigid bearings is disposed underneath said crusher.

4. The mobile crushing system according to claim 1, wherein said crusher is a jaw crusher.

5. The mobile crushing system according to claim 1, wherein said superstructure can be lowered by means of said hoisting device and placed on the ground by means of said rigid bearings such that said rigid bearings completely and directly transmit the weight of said superstructure along with the dynamic and static forces acting on said superstructure directly onto the ground.

6. The mobile crushing system according to claim 1, further comprising at least one of guiding means or centering means for aligning said superstructure in relation to said sub-construction in a hoisting operation.

7. The mobile crushing system according to claim 6, wherein said superstructure and said sub-construction have mutually allocated wedge surfaces forming said centering means.

8. The mobile crushing system according to claim 6, wherein said guiding means are selected from the group consisting of guiding pins and guiding rails.

9. The mobile crushing system according to claim 1, wherein said hoisting device has hydraulic cylinders.

10. The mobile crushing system according to claim 1, wherein said superstructure has a bearing frame to which said rigid bearings formed of a steel structure are welded.

11. The mobile crushing system according to claim 2, wherein said two parallel drive sets are a crawler pair.

* * * * *